United States Patent [19]

Inagawa et al.

[11] 4,290,037

[45] Sep. 15, 1981

[54] FLAT ELECTROMAGNETIC RELAY

[75] Inventors: Takashi Inagawa; Naoto Kushida; Akira Sekiguchi; Matujiro Ikeda; Hidetoshi Sugawara; Kunio Naito, all of Tokyo, Japan

[73] Assignee: Nippon Electric Co., Ltd., Tokyo, Japan

[21] Appl. No.: 13,217

[22] Filed: Feb. 21, 1979

[30] Foreign Application Priority Data

| | | | |
|---|---|---|---|
| Feb. 28, 1978 | [JP] | Japan | 53/23116 |
| Feb. 28, 1978 | [JP] | Japan | 53/23117 |
| Feb. 28, 1978 | [JP] | Japan | 53/25872[U] |
| Feb. 28, 1978 | [JP] | Japan | 53/25873[U] |
| Feb. 28, 1978 | [JP] | Japan | 53/25874[U] |

[51] Int. Cl.[3] ..... H01H 9/0 2; H01H 13/04; H01H 67/02; H01H 3/00

[52] U.S. Cl. ..... 335/202; 335/128; 335/129; 335/192

[58] Field of Search ..... 335/127, 128, 129, 192, 335/202

[56] References Cited

U.S. PATENT DOCUMENTS

| | | | |
|---|---|---|---|
| 3,247,345 | 4/1966 | Mekelburg et al. | 335/192 X |
| 3,278,872 | 10/1966 | Maynard | 335/128 X |
| 3,333,216 | 7/1967 | Stehlik | 335/128 X |
| 3,553,612 | 1/1971 | Zimmer | 335/128 |
| 3,553,729 | 1/1971 | Mori et al. | 335/192 |
| 3,681,722 | 8/1972 | Johnsen et al. | 335/202 |
| 3,949,332 | 4/1976 | Reuting | 335/128 X |
| 4,008,447 | 2/1977 | Anderson et al. | 335/128 |
| 4,010,433 | 3/1977 | Nishimura et al. | 335/129 |

*Primary Examiner*—Fred L. Braun

*Attorney, Agent, or Firm*—Laff, Whitesel & Rockman

[57] ABSTRACT

A flat electromagnetic relay which includes a base member having at least two projections extending from a flat surface thereof. At least one hole (or indent), fitting a pertinent one of the projections, is formed in each supporting block that holds a contact, yoke, a hinging spring, or the like. These and similar members are successively stacked on the surface of the base member, with the projections fitted through the holes in the supporting blocks. The free ends of the respective projections are then deformed to secure and hold the components in position. A contact actuating card is put in place after the stack of contact holding blocks is assembled and locked in position. The block through which a contact carrying leaf spring is molded preferably has an end surface formed at an angle such that a portion of the leaf spring may be subsequently bent to extend substantially perpendicular to the remainder of the leaf spring, thereby forming a solder terminal. When used between the base member surface and one of the blocks, a return spring is precisely positioned preferably by an additional projection formed on the base member surface. A dust cover for the relay may have a ridge for restricting the return movement of the armature.

8 Claims, 10 Drawing Figures

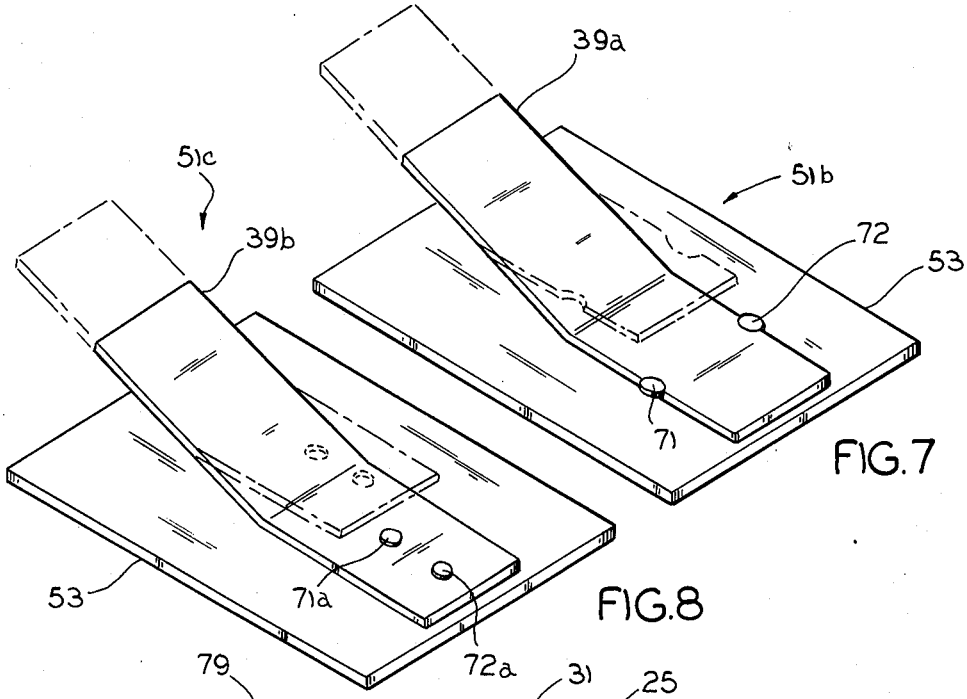
FIG.7
FIG.8
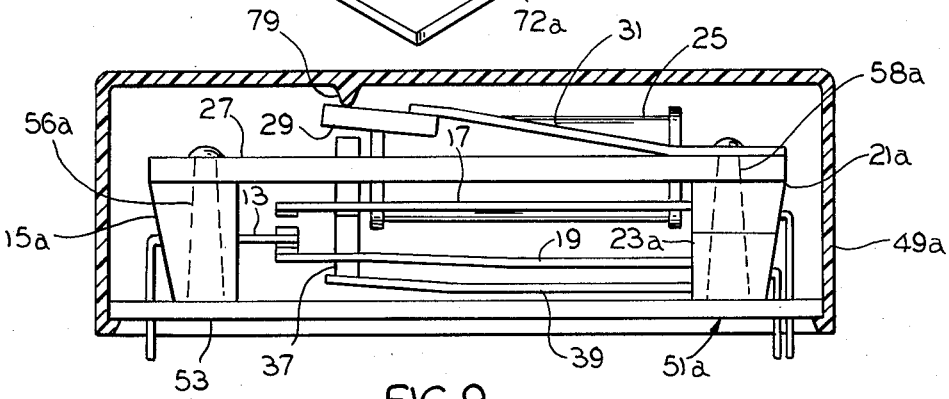
FIG.9
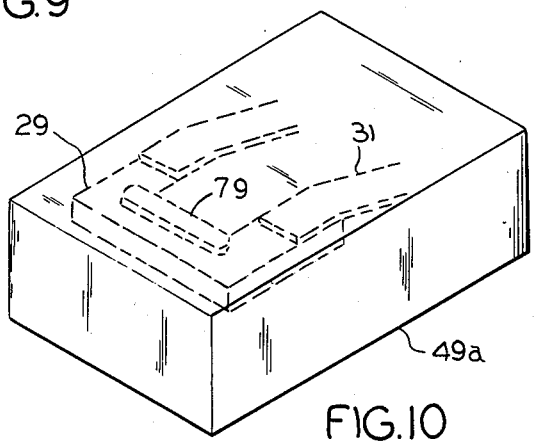
FIG.10

FLAT ELECTROMAGNETIC RELAY

This invention relates to an electromagnetic relay and, more particularly, to an electromagnetic relay of a type known as a flat or flat-type electromagnetic relay.

BACKGROUND OF THE INVENTION

A conventional electromagnetic relay has a great number of components. Furthermore, it has been troublesome to manufacture a conventional electromagnetic relay. As a result, it has been next to impossible to automatically manufacture conventional electromagnetic relays.

An electromagnetic relay comprises at least one pair of contacts, which may be carried by a pair of leaf springs, respectively. In such a case, it is convenient to provide a terminal or lead wire for each contact, to mould each leaf spring through a contact block, and to bend one end portion of the moulded leaf spring perpendicular to the other end portion thereof, which carries the contact. For use in a conventional electromagnetic relay, the bent end portion has to be adjusted through a number of complicated processes. Precise positioning of a return or balancing leaf spring has also been difficult. In addition, a back stop or stay for an armature has not always had a sufficient mechanical strength.

SUMMARY OF THE INVENTION

Therefore, a general object of the present invention is to provide an electromagnetic relay that comprises a reduced number of components and is readily manufactured.

Another general object of this invention is to provide a relay of the type described, which is adapted to be automatically manufactured.

A specific object of this invention is to provide a relay of the type described, for which it is readily feasible to form lead wires for relay contacts.

Another specific object of this invention is to provide a relay of the type described, for which it is possible to precisely position a return leaf spring.

Still, another specific object of this invention is to provide a relay of the type described, having a mechanically strong back stop for an armature.

This invention is applicable to an electromagnetic relay comprising a base member having a base plate with a generally flat surface, a first and a second contact block mounted on the surface, a yoke mounted on the first and the second contact blocks, and a hinging leaf spring mounted on the yoke. The first contact block holds at least one leaf spring having a stationary contact and the second contact block holds at least one leaf spring having a movable contact, which together form a relay contact pair. The yoke is accompanied by a coil. The hinging leaf spring carries an armature member for moving the movable contact in response to an energization or a deenergization of the coil.

According to this invention, the base member has at least two projections that stand perpendicularly and have free ends. Each of the first and the second contact blocks, the yoke and the hinging leaf spring have holes or are otherwise shaped to fit over the projections. The free ends of the projections have means for insuring the holding function of the projections after the fitting means are made to fit the projections.

The return leaf spring described above may be placed between the base plate surface and one of the first and the second contact blocks. The contact blocks may, therefore, be mounted on the base plate surface either directly or with the return leaf spring interposed between them. The first and the second contact blocks hold the stationary and the movable contacts, preferably through the intermediary of a first and a second leaf spring, respectively. It is also possible to use a base member comprising only one projection.

BRIEF DESCRIPTION OF THE DRAWING

FIG. 7 is a perspective view of a base member and a return leaf spring for use in an electromagnetic relay according to a fourth embodiment of this invention;

FIG. 8 is a perspective view of a modified assembly of the base member and the return leaf spring shown in FIG. 7;

FIG. 9 illustrates a side view of an electromagnetic relay according to a fifth embodiment of this invention with a portion of a dust cover in cross section; and FIG. 10 is a perspective view of the dust cover used on the electromagnetic relay depicted in FIG. 9.

DESCRIPTION OF THE PREFERRED EMBODIMENTS

Figure 1:
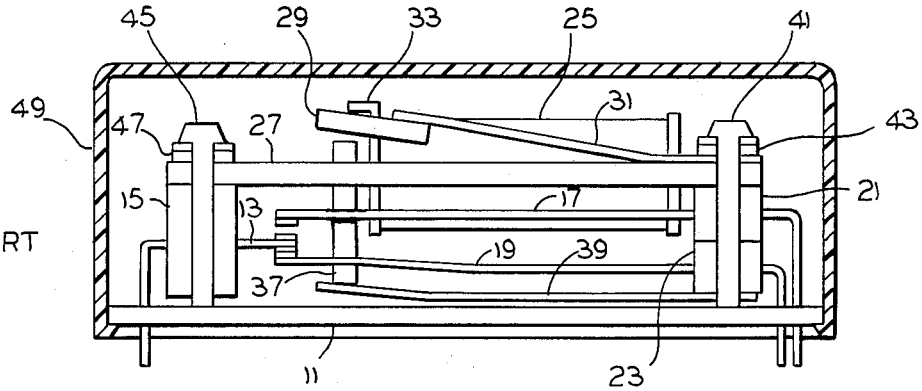
FIG. 1 PRIOR ART
FIG. 1 is a side view of a conventional electromagnetic relay, with a portion of a dust cover shown in cross section.
Figure 2:
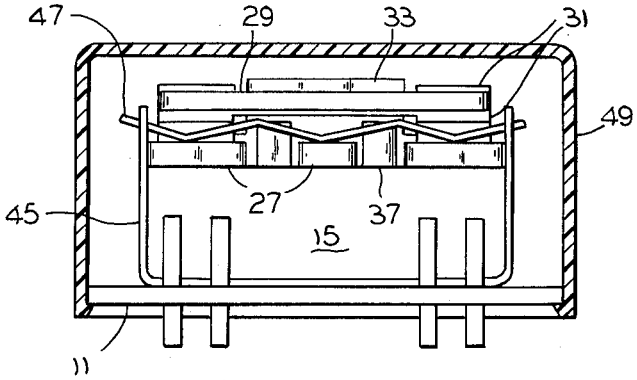
FIG. 2 PRIOR ART
FIG. 2 illustrates a front view of the conventional relay, also with the dust cover in cross section.

In FIGS. 1 and 2, a conventional electromagnetic relay is illustrated in a deenergized state. This relay is described first in order to facilitate an understanding of the invention. The relay comprises a base member 11 that is merely a plate, in the example being illustrated. The base plate 11 has a generally flat upper surface. Mounted on a front end area of the base plate surface is a first contact assembly comprising a first leaf spring 13 moulded in a first contact block 15 and carrying two stationary or fixed contacts on both surfaces thereof. A second and a third contact assembly comprise second and third leaf springs 17 and 19 moulded in spring blocks or second and third contact blocks 21 and 23, respectively, that are mounted in a rear end area of the base plate 11. The second and third leaf springs 17 and 19 extend generally parallel to and toward the front end of the base plate 11. Movable contacts on springs 17 and 19 form a make and a break contact pair respectively, in cooperation with the stationary contacts.

A yoke assembly is mounted on the first and the second contact blocks 15 and 21. A coil 25 is wound around a hollow spool that is received by a central leg of an E-shaped yoke 27. A pair of side yoke legs are directed toward the front end of the base plate 11. An armature assembly, placed on the yoke assembly, comprises a U-shaped armature 29 having a pair of legs that are carried by a hinging leaf spring 31, fixed to the rear end of the yoke 27. A back stop or stay 33 for the armature 29 is made integral with a front end of the spool for the coil 25.

Terminals or lead wires extend from the first through the third leaf springs 13, 17 and 19 through the respective contact blocks 15, 21 and 23 and also from the coil 25. In the illustrated example, the first leaf spring 13 consists of those two pairs of leaf springs on both sides of the coil 25, each of which carries two stationary contacts on both surfaces thereof. Each of the second and the third leaf springs 17 and 19 likewise consists of two leaf springs, each of which carries a movable contact for a make or a break contact pair.

FIGS. 1 and 2 also show that after the second and the third contact assemblies are successively stacked on the yoke assembly on which the armature assembly is placed in the position shown. A pair of sidewardly extended arms of a generally U-shaped contact actuating card 37 is inserted between the second and the third leaf springs 17 and 19. A pair of parallel legs on card 37 extends through a pair of spaces or gaps between the side and the central legs of the yoke 27. With a balancing or return leaf spring 39 brought into contact with the card 37 and the third contact block 23, the above-described assembly is clamped together by the use of a rear clamping plate or member 41 and a rear clamping spring 43. The first contact assembly is combined with the yoke assembly by means of a front clamping member 45 and a front clamping spring 47. After the whole assembly is placed on the base plate 11, with the lead wires extended through holes formed therethrough, a dust cover 49 is fitted to the base plate 11. The dust cover 49 is usually transparent and may be either removably held on the base plate 11 or hermetically sealed thereto.

The relay illustrated in FIGS. 1 and 2 has a great number of components. It is quite troublesome to assemble these components into the electromagnetic relay. Each of the first through the third contact assemblies may be manufactured, by moulding a leaf spring 13, 17 or 19 through a spring block 15, 21 or 23. Thereafter, one end portion of the moulded leaf spring is bent perpendicular to the remaining leaf spring to provide a terminal (usually a solder terminal) for the contact or contacts carried by the moulded leaf spring. The resilience of the spring makes it difficult to bend the leaf spring end portions, merely by the use of a single bending tool. Therefore, a reshaping of the bent end portion has had to be carried out by complicated spring-forming means. It has not been easy to precisely position the return leaf spring 39 when it is manufactured as a separate component to be placed on the base plate 11. The back stop 33 has been mechanically weak and has had a short life. Although the actuating card 37 generally need not be brought into contact with the armature 29 when the coil 25 or the relay is deenergized, the armature 29 and the card 37 should cooperate as an armature member to move the movable contact between an actuated and a rest position whenever the coil 25 is energized and deenergized.

Figure 3:
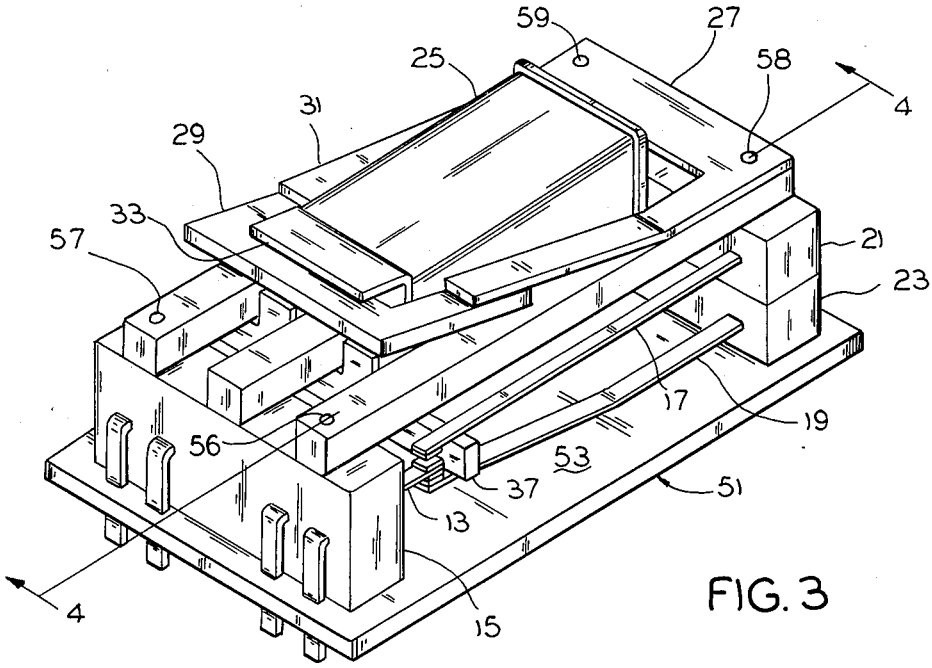
FIG. 3 shows a perspective view of an electromagnetic relay, according to a first embodiment of the present invention, with a dust cover removed.
Figure 4:
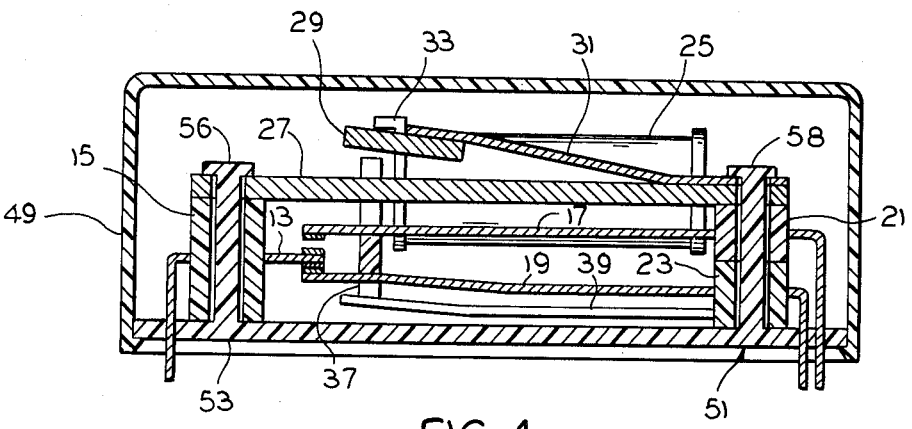
FIG. 4 is a longitudinal sectional view taken along a line 4—4 of FIG. 3.

In FIGS. 3 and 4, a first embodiment of an inventive electromagnetic relay is shown in the deenergized state. Those parts which are similar to parts described above are designated by like reference numerals. A novel base member 51 is substituted for the conventional base plate 11. The base member 51 comprises a base plate 53 having a generally flat upper surface. The base member 51 preferably has front and rear cylindrical projections with generally circular cross sections. For example, first and second front and first and second rear projections 56, 57, 58 and 59 stand at predetermined positions on the base plate surface and project perpendicularly therefrom.

It is possible to readily manufacture the whole base member 51 as an integral piece by moulding polyester or a similar resin. Alternatively, it is possible to individually manufacture the base plate 53 and the projections 56 through 59 and, separately, to assemble these individually manufactured parts to form an integral base member 51 by cementing the projections 56 through 59 to the base plate 53, by a suitable adhesive. If so, the individually manufactured base plate 53 may have holes or indents at predetermined positions, into which the projections 56 through 59 are fitted with or without an adhesive.

In any event, the first contact block 15 and each of the second and the third contact blocks 21 and 23 have holes that precisely fit over the front projections 56 and 57 and the rear projections 58 and 59, respectively. Such holes are readily formed when moulding the blocks 15, 21 and 23. The yoke 27 also has holes that fit over the respective projections 56 through 59. When the yoke 27 is made of a metal, such as pure iron, the holes are preferably formed by punching the yoke 27 from a sheet of metal. The hinging leaf spring 31 has holes that fit over the rear projections 58 and 59, respectively. The last-mentioned holes are preferably formed at the time when the hinging leaf spring 31 is punched from a sheet of resilient metal. In the illustrated example, the return leaf spring 39 is not depicted in FIG. 3 because it is not visible in this view. However, it has the third contact assembly, as best shown in FIG. 4. As would be seen in FIGS. 3 and 4, the armature 29 need not have rear leg ends which must always be brought into contact with the yoke 27.

As seen in FIGS. 3 and 4, the novel base member 51 quite astonishingly makes it possible for an automatic assembling machine to readily assemble the components into an electromagnetic relay. More specifically, the third contact assembly is placed on the upper surface of the base member 51 by making the holes thereof fit over the rear projections 58 and 59. The actuating card 37 is put on the return leaf spring 39, with the cards sidewardly extending arms resting on the third leaf springs, such as 19, respectively. The first and the second contact assemblies are successively positioned on the base member and on the third contact block 23, respectively, by making the holes thereof fit over the respective projections 56 through 59. The armature assembly is placed on the yoke 27 by merely making the holes thereof fit over the rear projections 58 and 59.

It should now be understood that the holes formed in the first through the third contact blocks 15, 21 and 23, the yoke 27, and the hinging leaf spring 31 serve as both an indexing and a clamping means capable of fitting over the projections 56 through 59. Conversely, the projections 56 through 59 hold together the base member 53, the first through the third contact assemblies, the yoke assembly, and the armature assembly, thereby performing the functions of a fitting means. After the components are thus received by the projections 56 through 59, the free ends of the respective projections 56 through 59 are suitably deformed to insure the holding function of the projections 56 through 59. The deformation may be carried out, for example, by heating the free ends of the projections and pressing them against the yoke 27 and the hinging leaf spring 31.

Inasmuch as the inventive relay is typically about 30 mm long, 20 to 25 mm wide (according to the number of the contact pairs arranged on a plane), and 10 mm high, each projection 56–59 or the like may be about 1.6 mm in diameter. When the whole base member 51 is made of poly-(butylene terephthalate) known as PBT, it is sufficient to heat the free ends of the projections 56 through 59, of the exemplified dimensions, by a mould which is heated to a temperature in the range of about 130° to 200° and to apply a pressure of about 4 to 6 kg/cm$^2$ for approximately 5 to 6 seconds. Alternatively, it is possible to deform the free ends of the projections either by an ultrasonic processor by using separate deforming pieces, such as wedges or eyelets.

Figure 5:
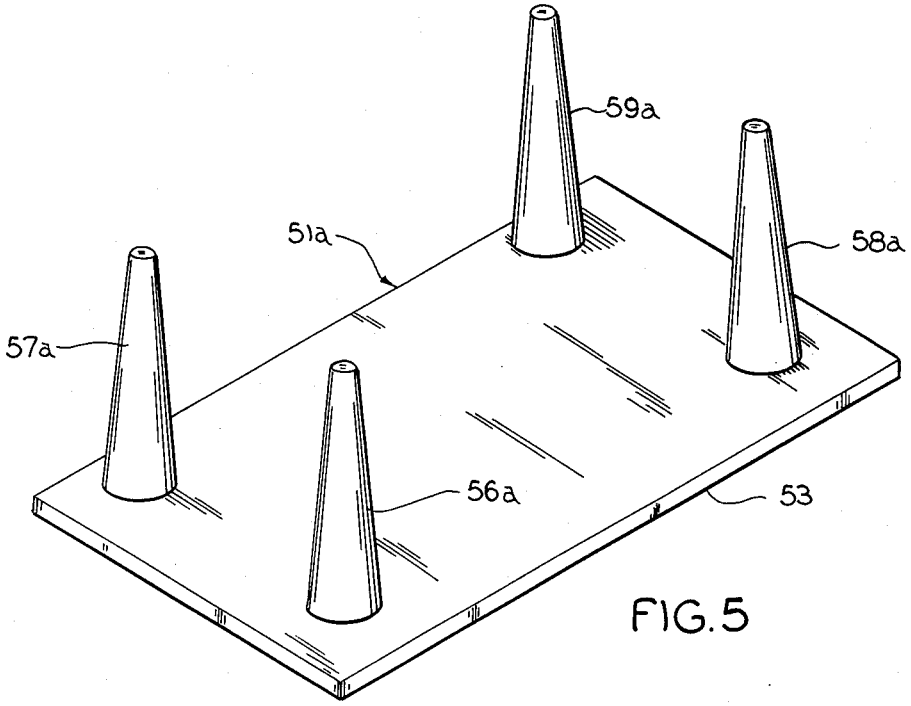
FIG. 5 is a perspective view of a base member for use in an electromagnetic relay according to a second embodiment of this invention.

FIG. 5 is a perspective view of a base member 51*a* for use in a second embodiment of an electromagnetic relay, according to this invention. Member 51*a* comprises a base plate 53 and four generally conical projections 56*a*, 57*a*, 58*a* and 59*a* having circular cross sections. Holes for the respective lead wires are not shown here in order to simplify the illustration. Typical diameter dimensions of each projection 56*a*, or the like, are approximately 1.55 mm at the point contiguous to the base plate surface and approximately 1.30 mm at the free end. The taper of projections 56*a* through 59*a* makes it easy to remove the integrally moulded base members, such as 51*a*, from a mould and also to slip the contact, the yoke, and the armature assemblies into their assembled positions.

Figure 6:
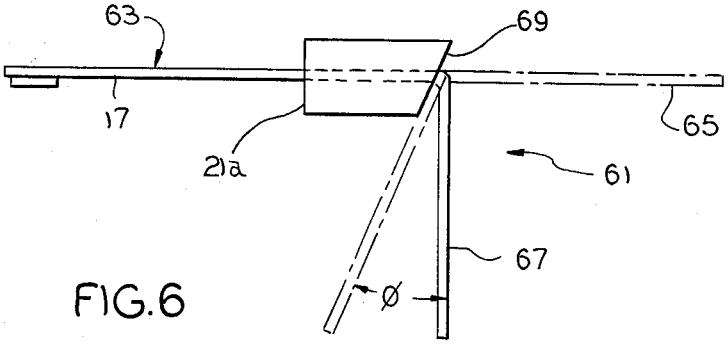
FIG. 6 is a side view of a contact assembly for use in an electromagnetic relay according to a third embodiment of this invention.

In FIG. 6, a contact assembly 61 is shown for use in a third embodiment of the electromagnetic relay. This assembly is used in place of the second contact assembly illustrated in FIGS. 3 and 4.

The contact assembly 61 comprises a long leaf spring 63 centrally embedded in a moulded spring block 21*a* that corresponds to the second contact block 21. The leaf spring 63 thus has first and second end portions extended outwardly from a pair of end surfaces of the spring block 21*a*. The first end portion serves as the second leaf spring 17 with a movable contact attached thereo, at a point adjacent a free end thereof. The second end portion depicted at 65 by single dot-dash lines at 65 is subsequently bent, as shown by full lines at 67, perpendicular to the moulded block 21*a*, to serve as a terminal for the movable contact.

On moulding the spring block 21*a*, that one of the end surfaces from which the second end portion 65 extends is inclined to provide a surface 69 forming an acute angle Φ with respect to the end portion 67, as it is later bent. The acute angle Φ is preferably equal to an angle by which the second end portion 67 springs back after it is once brought into contact with the inclined end surface 69 (as indicated by two dot and dash lines) and then set free. When the leaf spring 63 is punched from a phosphor bronze sheet, having a thickness of 0.18 mm and a width of 0.8 mm, the angle Φ of spring back is about 5°.

The relay according to the third embodiment of this invention has a third contact assembly that comprises a moulded spring block 23*a* (not shown in FIG. 6) having a similarly inclined end surface and a long leaf spring moulded therethrough and bent afterwards. The first contact block 15 may hold the stationary contact or contacts rigidly in a relay, according to the first or second embodiment of this invention.

A relay according to the third embodiment comprises a first contact assembly that includes a spring block having an inclined end surface and a slightly longer leaf spring moulded therethrough. The terminal end is subsequently bent to provide for the stationary contact or contacts. When the leaf spring moulded through the spring block corresponding to block 15 is a phosphor bronze strip 0.3 mm thick and 0.8 mm wide, the angle Φ of spring back is again about 5°. These spring blocks 21*a*, and others corresponding to blocks 15 and 23, make it possible to use a simple automatic machine for manufacturing the contact assemblies. As a result, it is possible to manufacture electromagnetic relays in accordance with the third embodiment of this invention by a use of an automatic assembling machine.

In FIG. 7, a base member 51*b* is for use in an electromagnetic relay according to a fourth embodiment of this invention. A return leaf spring 39*a* is manufactured as a separate component and placed between the base plate surface and one of the first or third contact blocks 15 and 23. The base member 51*b* comprises a base plate 53, at least two cylindrical or generally conical projections (similar to 56 or 56*a*) and so forth. These projections are not depicted herein in order to simplify the illustration. An additional projection may be provided at a preselected position on the base plate surface. In the illustrated example (FIG. 7), two such additional projections 71 and 72 are formed at positions parallel to a transverse axis of the base plate 53, and separated by a distance which is somewhat shorter than the width of the return leaf spring 39*a*. Indents on the spring fit over the additional projections 71 and 72, respectively. The return leaf spring 39*a* is readily and precisely positioned on the base plate surface.

In FIG. 8, a base member 51*c* is for use in an electromagnetic relay, according to a modification of the fourth embodiment of this invention. The base member 51*c* comprises two additional projections 71*a* and 72*a*, which are located along a longitudinal axis of the base plate 53 rather than along the transverse axis thereof. For use in combination with the base member 51*c*, a separately manufactured return leaf spring 39*b* is provided with two holes that fit over the respective additional projections 71*a* and 72*a*. It should also be understood that more than two additional projections may be arranged on the base plate surface at properly preselected positions.

From FIGS. 3 through 5, it is now understood that the first through the third contact blocks 15, 21 and 23, or 15*a*, 21*a* and 23*a* (FIG. 9), the yoke 27, and the hinging leaf spring 31 may have indents instead of all or some of the holes, to serve as the fitting means. This use of indents is possible, provided that the projections 56 or 56*a*, and so on, are capable of securely holding together the base plate 53 and the contact, the yoke and the armature assemblies. These indents may provide the fitting functions either in cooperation with or without the cooperation of the hole or holes. The fitting tolerance is not too critical. This applies to the fitting tolerance for the additional projection or projections, such as 71 or 71*a*, 72 or 72*a*, and the fitting means of the separately manufactured return leaf spring 39*a* or 39*b*.

The projections 56 or 56*a*, and so forth, may have an elliptical or a polygonal cross section, particularly when only two projections are used for each base member 51, 51*a*, 51*b* or 51*c*. This is because such projections are capable of correctly indexing or orienting the assemblies, such as the contact and the armature assemblies, which are held by only one of the projections under the circumstances. Circular holes or circularly arcuate indents may be used to fit prismal projections or generally elliptically conical or generally pyramidal projections. The expression "to fit" and the like expressions, such as "a fit," should, therefore, be understood in a broad sense. A clearance fit is preferred to an interference fit, particularly when the fitting means and at least those portions of the cooperating projections 61 or 61*a* and others, respectively, are of a similar or corresponding geometry.

In order to properly orient the contact, the yoke and the armature assemblies relative to the base member 51, 51*a*, 51*b* or 51*c*, it is also possible to form at least one ridge or keying index on at least one of the components, including the base plate. To be combined together, an indent is formed in the component to be combined with the keying ridge or ridges.

It is possible to substitute a single spring block for the second and the third contact blocks 21 and 23 or 21*a* and 23*a* (FIG. 9) and still resort to an automatic assembling machine for assembling the whole electromagnetic relay. The projection or projections for the first contact block 15 or 15*a* and the means fitting thereover may be assembled either with or without the use of the keying ridge and indent combination or combinations between the first contact block 15 of 15*a* and the yoke 27.

Finally, FIGS. 9 and 10 show an electromagnetic relay according to a fifth embodiment of this invention. Similar parts are designated by the same reference numerals which are used in FIGS. 3 through 6. The relay is again depicted in the deenergized state. The base member 51*a* and the contact blocks 15*a*, 21*a* and 23*a* are used in the electromagnetic relays according to the second and the third embodiments of this invention. The relay illustrated in FIGS. 9 and 10 does not have the back stop 33 attached to the bobbin of the coil 25. Instead, a dust cover 49*a* has a ridge 79 that projects inwardly, parallel to a transverse axis thereof, to serve as a novel back stop for the armature 29. The ridge 79 is mechanically stronger than the back stop 33. The fact that the armature assembly is stacked on the base plate 53, with the contact and the yoke asemblies interposed, does not present any problem to the accuracy of the rest position of the armature 29 at the end of its return movement, when the coil 25 is deenergized.

This invention has thus far been described in conjunction with several preferred embodiments and a number of modifications thereof. However, it should be understood that the spirit of this invention is applicable to electromagnetic relays of various other structures. For example, each contact may be a twin contact, as is known in the art. Means may be provided for insuring the holding function of the cylindrical, prismal, or generally conical or pyramidal projections. By resorting to an interference fit of the fitting means on the yoke 27, the respective projections with the armature assembly may be fixed to the yoke 27 in any of the conventional ways. It is to be noted that the free ends of the respective projections 56 or 56*a*, and so on, are deformed to a certain extent.

Alternatively, it is possible to totally dispense with the holding means. A single base member may have a columnar and a generally conical or pyramidal projection. The base member may comprise only one projection for holding the relay components when this is sufficient to fixedly hold together the base plate 53, the contact block for the stationary or the movable contact or contacts, and the yoke and the armature assemblies. For the latter purpose, use may be made of a conventional front clamping member 45 together with a conventional front clamping spring 47. Even in this case, it is possible to reduce the number of relay components. The cylindrical or the like projections 56 or 56*a* and others are not necessarily substantially exactly perpendicular to the base plate surface. What is mandatory is that the contact, the yoke and the armature assemblies are readily stacked successively on the base plate surface, with suitable fitting over the projections. Therefore, the projection may be approximately perpendicular to the base plate surface within a certain degree of tolerance.

The appended claims are to be construed broadly to cover all embodiments of the invention and all equivalent structures falling within the true scope and spirit of the invention.

What is claimed is:

1. An electromagnetic relay comprising:

a base member having a generally flat surface, and at least first and second projections standing substantially perpendicularly at predetermined positions on said surface thereof and having free ends, respectively;

first and second contact block means respectively fitting over said first and second projections to rest upon said surface, said first and second contact block means respectively holding stationary and movable contacts;

yoke means with an associated coil fitted over both said first and second projections to rest on said first and second contact blocks;

hinging leaf sping means fitted over one of said first and second projections and carrying an armature means for moving said movable contact in response to energization and deenergization of said coil; and means associated with the free ends of said projections for holding together said contact block means, said yoke means and said leaf spring means; wherein said first and second contact block means are made of a mouldable material and hold said stationary and said movable contacts with individually associated first and second leaf springs having portions extending away from and beyond opposite surfaces of an individually associated one of said first and said second contact block means, the first end portions of said first and said second leaf springs being substantially aligned with the respective moulded blocks to carry said contacts thereon, the second end portions of said first and said second leaf springs being bent substantially perpendicular to an end surface on each of said first and said second moulded blocks from which the second end portion of the leaf springs extends; and wherein said end surface on each of said first and second moulded blocks is inclined to form an acute angle with respect to the bent end portion of the leaf spring.

2. An electromagnetic relay as claimed in claim 1 further comprising a return leaf spring mounted between said base member surface and one of said first and said second contact block means, means for operatively coupling said return leaf spring to said movable contact to urge said movable contact toward a rest position when said coil is deenergized, said base member comprising an additional projection at a preselected position on said base member surface, said return leaf spring comprising means fitting over said additional projection and held on said base member surface responsive to a cooperation between said additional projection and the fitting means of said return leaf spring.

3. An electromagnetic relay as claimed in claim 2, further comprising a dust cover held on said base member for enclosing said first and said second contact block means, said stationary and said movable contacts, said yoke, said coil, said hinging leaf spring means, and said armature means in cooperation with said base member, wherein said dust cover includes a ridge for positioning said armature means when said coil is deenergized.

4. An electromagnetic relay having a base member comprising a base plate with a generally flat surface, a first and a second contact block means supported by said surface, a yoke means supported by said first and said second contact block means, and hinging leaf spring means mounted on said yoke means, said first contact block means holding at least one stationary contact, said second contact block means holding at least one movable contact that cooperates with said one stationary contact to form a relay contact pair, said first and said second contact block means being made of a mouldable material and holding said stationary and said movable contacts with individually associated first and second leaf springs having portions extending away from and beyond opposite surfaces of an individually associated one of said first and said second contact block means, the first end portions of said first and said second leaf springs being substantially aligned with the respective moulded blocks to carry said contacts thereon, the second end portions of said first and said second leaf springs being bent substantially perpendicular to an end surface on each of said first and said second moulded blocks from which the second end portion of the leaf spring extends, said end surface being inclined to form an acute angle with respect to the bent end portion of the leaf spring, said yoke means having an associated coil, said hinging leaf spring means carrying an armature means for moving said movable contact in response to an energization or a deenergization of said coil, said base member having at least two projections standing approximately perpendicularly at predetermined positions on said surface, each of said projections having a free end, said first and said second contact block means, said yoke means and said hinging leaf spring means fitting over the free ends of said projection and resting on said flat surface, and means associated with the free ends of said projections for holding together the said means which are fitted over said free ends.

5. An electromagnetic relay as claimed in claim 4, wherein said acute angle is equal to an angle of spring back for the second end portion after said second end portion is brought into contact with the inclined end surface and then set free.

6. An electromagnetic relay as claimed in claim 5, further comprising a dust cover held on said base member for enclosing said first and said second contact block means, said stationary and said movable contacts, said yoke, said coil, said hinging leaf spring means, and said armature means in cooperation with said base plate, wherein said dust cover includes a ridge for positioning said armature means when said coil is deenergized.

7. An electromagnetic relay as claimed in claim 5 further comprising a return leaf spring mounted between said base plate surface and one of said first and said second contact block means, means for operatively coupling said return leaf spring to said movable contact to urge said movable contact toward a rest position when said coil is deenergized, said base member comprising an additional projection at a preselected position on said base plate surface, said return leaf spring comprising means fitting over said additional projection and held on said base plate surface responsive to a cooperation between said additional projection and the fitting means of said return leaf spring.

8. An electromagnetic relay having a base member comprising a base plate with a generally flat surface, a first and a second contact block means supported by said surface, a yoke means supported by said first and said second contact block means, and hinging leaf spring means mounted on said yoke means, said first contact block means holding at least one stationary contact, said second contact block means holding at least one movable contact that cooperates with said one stationary contact to form a relay contact pair, said first and second contact block means being made of a mouldable material and holding said stationary and said movable contacts with individually associated first and second leaf springs having portions extending away from and beyond opposite surfaces of an individually associated one of said first and said second contact block means, the first end portions of said first and said second leaf springs being substantially aligned with the respective moulded blocks to carry said contacts thereon, the second end portions of said first and said second leaf springs being bent substantially perpendicular to an end surface on each of said first and said second moulded blocks from which the second end portion of the leaf spring extends, said end surface being inclined to form an acute angle with respect to the bent end portion of the leaf spring, said yoke means having an associated coil, said hinging leaf spring means carrying an armature means for moving said movable contact in response to an energization or a deenergization of said coil, said base member having at least two projections standing approximately perpendicularly at predetermined positions on said surface, each of said projections having a free end, said first and said second contact block means, said yoke means and said hinging leaf spring means each comprising walls defining at least one hole in each of said first and said second contact block means and in said hinging leaf spring means, at least two holes in said yoke means, each of said holes fitting over a corresponding free end of one of said projections, and resting on said flat surface, and means associated with the free ends of said projections for holding together the said means fitted over said free ends.

* * * * *